US005350973A

United States Patent [19]

Yokota et al.

[11] Patent Number: 5,350,973

[45] Date of Patent: Sep. 27, 1994

[54] CATHODE-RAY TUBE APPARATUS HAVING A REDUCED LEAK OF MAGNETIC FLUXES

[75] Inventors: Masahiro Yokota, Fukaya; Kiyoshi Oyama, Yokohama; Hideo Mori, Fukaya, all of Japan

[73] Assignee: Kabushiki Kaisha Toshiba, Kawasaki, Japan

[21] Appl. No.: 65,451

[22] Filed: May 21, 1993

Related U.S. Application Data

[63] Continuation of Ser. No. 856,810, Mar. 24, 1992, abandoned, which is a continuation of Ser. No. 543,398, Jun. 26, 1990, abandoned.

[30] Foreign Application Priority Data

Aug. 31, 1989 [JP] Japan ..... 1-225649

[51] Int. Cl.[5] ..... H01F 13/00

[52] U.S. Cl. ..... 315/8; 315/85

[58] Field of Search ..... 315/7, 8, 85; 361/150, 361/146; 313/440, 431, 442, 413, 429, 433; 307/10.1, 10.8

[56] References Cited

U.S. PATENT DOCUMENTS

| | | | |
|---|---|---|---|
| 3,879,633 | 4/1975 | Stark, Jr. | 315/8 |
| 4,634,930 | 1/1987 | Toshiyasu et al. | 315/8 |
| 4,851,737 | 7/1989 | Johansson et al. | 315/8 |
| 4,853,588 | 8/1989 | Ohtsu et al. | 315/8 |
| 4,857,805 | 8/1989 | Bosch et al. | 315/8 |
| 4,899,082 | 2/1990 | Sands et al. | 315/8 |
| 4,908,550 | 3/1990 | Chase et al. | 315/8 |
| 4,914,350 | 4/1990 | Bosch et al. | 315/8 |
| 4,922,153 | 5/1990 | Kevius | 315/8 |
| 4,940,920 | 7/1990 | Giannantonio et al. | 315/8 |
| 4,943,755 | 7/1990 | Toshiyasu et al. | 315/8 |
| 4,947,083 | 8/1990 | Bosch et al. | 315/8 |
| 5,038,078 | 8/1991 | Duggan | 315/8 |
| 5,049,847 | 9/1991 | Okuyama et al. | 315/8 |
| 5,107,179 | 4/1992 | Vidovich | 315/8 |

FOREIGN PATENT DOCUMENTS

| | | | |
|---|---|---|---|
| 0371618 | 6/1990 | European Pat. Off. . | |
| 58-104591 | 6/1983 | Japan | 315/8 |
| 62-64024 | 3/1987 | Japan . | |
| 62-193048 | 8/1987 | Japan . | |
| 62-223952 | 10/1987 | Japan . | |
| 8706054 | 10/1987 | World Int. Prop. O. . | |
| 8804469 | 6/1988 | World Int. Prop. O. . | |

*Primary Examiner*—Robert J. Pascal
*Assistant Examiner*—Tan Dinh
*Attorney, Agent, or Firm*—Cushman, Darby & Cushman

[57] ABSTRACT

In a cathode-ray tube apparatus, a deflection yoke is provided on a funnel of a tube and a pair of closed loop coils are provided on a panel and the funnel of the tube at upper and lower sides, respectively. The deflection yoke generates effective magnetic fluxes in the tube and also generates ineffective magnetic fluxes as leakage magnetic fluxes outside of the tube. Some of the leakage magnetic fluxes pass through the coils so that currents are induced in the coils and the resulting induced magnetic fluxes compensate for the leakage magnetic fluxes. Thus, the leakage magnetic fluxes passing through a space in front of the tube are reduced by the compensating magnetic fluxes from the coils.

26 Claims, 16 Drawing Sheets

CATHODE-RAY TUBE APPARATUS HAVING A REDUCED LEAK OF MAGNETIC FLUXES

This is a continuation of application Ser. No. 07/856,810, filed on Mar. 24, 1992 and now abandoned which was a continuation of application Ser. No. 07/543,398, filed on Jun. 26, 1990, now abandoned.

BACKGROUND OF THE INVENTION

1. Field of the Invention

The present invention relates to a cathode-ray tube apparatus wherein leakage magnetic fluxes extending from a deflection yoke can be reduced.

2. Description of the Related Art

Unnecessary radiation, such as electronic waves, is controlled in accordance with the regulations such as VDE (Verband Deutscher Elektrotechniker). Generally, the leakage magnetic field of cathode-ray tubes are also controlled in accordance with VDE.

The recent trend is to limit leakage magnetic fields harmful to human being, particularly in Northern European countries, in accordance with MPR (SSI) regulations. Subjected to these regulations are magnetic fields of frequencies ranging from 1 KHz to 400 KHz. In the case of cathode-ray tubes, it is required to reduce, to a considerably low level, the intensity of leakage magnetic fluxes which are some of the magnetic fluxes generated by the horizontal deflection coil of the deflection yoke; and which do not serve to deflect the electron beams emitted from the electron gun assembly.

To control the leakage magnetic fluxes emanating from cathode-ray tube apparatuses, it is necessary to attenuate these fluxes in a predetermined manner. However, the leakage magnetic fluxes must not be attenuated in a manner that the effective magnetic fluxes are influenced to degrade the deflection characteristics of the deflection yoke, such as beam convergence and beam landing.

FIG. 1 is a perspective view showing a deflection yoke of popular type for use in a cathode-ray tube, such as a color cathode-ray tube. The deflection yoke comprises a molded member 1 and a pair of saddle-type main horizontal deflection coils 2 positioned in the member 1, symmetrically to each other with respect to the horizontal axis (i.e., X axis). Most of the magnetic fluxes generated by the coils 2, generally known as "effective magnetic fluxes," are confined in the deflection yoke, or within a hollow cylindrical core 3 which surrounds the molded member 1, and effectively serve to deflect electron beams in horizontal direction. The remaining magnetic fluxes, generally known as "leakage magnetic fluxes," radiate from the deflection yoke.

FIG. 2 is a diagram illustrating the distribution of the effective magnetic fluxes 6 and that of the leakage magnetic fluxes 7 and 10. As FIG. 2 shows, two reference leakage magnetic fluxes 8*a* and 8*b* emanate from the horizontal deflection coils 2 along lines defining an angle of 30° to 40°. As is evident from FIG. 2, the leakage magnetic fluxes 7, which extend from a flange portions 9 of the coils 2 substantially in parallel to the effective magnetic fluxes 6, exist in the region between the reference leakage magnetic fluxes 8*a* and 8*b*, whereas the leakage magnetic fluxes 10, which extends in the direction opposite to that of the effective magnetic fluxes 6, exit outside the region.

Various methods of controlling the leakage magnetic fluxes emanating from the outer periphery of the cathode-ray tube have been devised, one of which is to enclose the entire deflection yoke within a metal case. This method does not suffices to reduce the leakage magnetic fluxes to a desirable level. Further it is disadvantageous in two respects because of the use of the metal case covering the whole deflection yoke. First, a sufficient heat radiation is impossible. Secondly, the metal case is rather an expensive member and inevitably increases the manufacturing cost of the cathode-ray tube apparatus.

Published Unexamined Japanese Patent Application No. 62-64024 discloses a cathode-ray tube apparatus, in which as is shown in FIG. 3, a pair of auxiliary coils 11 having substantially the same shape as saddle-type main horizontal deflection coils 2 are located symmetrically to each other with respect to a core 3, opposing the main horizontal deflection coils, respectively. Part of the current flowing in either main horizontal deflection coil 2 is supplied to the corresponding auxiliary coil 11 in opposite phase, such that the auxiliary coils 11 generate magnetic fluxes (hereinafter referred to as "auxiliary magnetic fluxes") which extend opposite to the main magnetic fluxes emanating from the main coils 2 and which reduce the leakage magnetic fluxes also emanating from the main coils 2.

It is difficult, however, to control the auxiliary coils 11 accurately enough to reduce the leakage magnetic fluxes which exist in particular positions. Further, since the auxiliary coils 11 are located at the places where less leakage magnetic fluxes exist than other places, the leakage magnetic fluxes are reduced excessively at the rear of the deflection yoke, inevitably generating reverse leakage magnetic fluxes. The reverse leakage magnetic fluxes, thus generated in the vicinity of the yoke, are liable to influence the deflection characteristics of the deflection yoke.

As has been pointed out, the use of a metal case to reduce the leakage magnetic fluxes results in an inadequate heat radiation from the deflection yoke and also in an increase in the manufacturing cost of the cathode-ray tube apparatus, and the provision of auxiliary coils adversely influences the deflection characteristics of the cathode-ray tube apparatus.

SUMMARY OF THE INVENTION

The object of the present invention is to provide a cathode-ray tube apparatus, in which the leakage magnetic fluxes emanating from the saddle-type main horizontal deflection coils of the deflection yoke are greatly reduced without considerably influencing the deflection characteristics of the yoke, such as beam convergence and beam landing.

According to the present invention, there is provided a cathode-ray tube apparatus which comprises: electron beam emitting means for emitting an electron beam; light ray producing means for producing light rays when irradiated with the electron beam; an envelope having an axis and enclosing the electron beam emitting means and the light ray producing means; deflection magnetic field generating means located outside the envelope, for generating and applying effective magnetic fluxes into the envelope, thereby to deflect the electron beam in a horizontal direction, and also for generating leakage magnetic fluxes extending in a direction different from that of the effective magnetic fluxes; and control means located across the leakage magnetic fluxes, in which a current is induced, and which generates compensating magnetic fluxes from the current thus induced, thereby to control the leakage magnetic fluxes.

According to the present invention, there is also provided a cathode-ray tube apparatus comprising: an envelope having an axis and comprising a panel having a face plate and a skirt continuous to the face plate, a funnel connected to the skirt of the panel, and a neck extending from the funnel; an electron gun assembly located within the neck, for emitting electron beams; a screen formed on the face plate, for producing light rays when irradiated with the electron beams; horizontal deflection means mounted on the funnel, for generating deflection magnetic fields for deflecting the electron beams in a horizontal direction, along with leakage magnetic fluxes outside the envelope; and loop-shaped conductor means extending along the skirt of the panel and also along the funnel toward the horizontal deflection means, and crossing the leakage magnetic fluxes, whereby a current is induced to generate compensating magnetic fluxes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
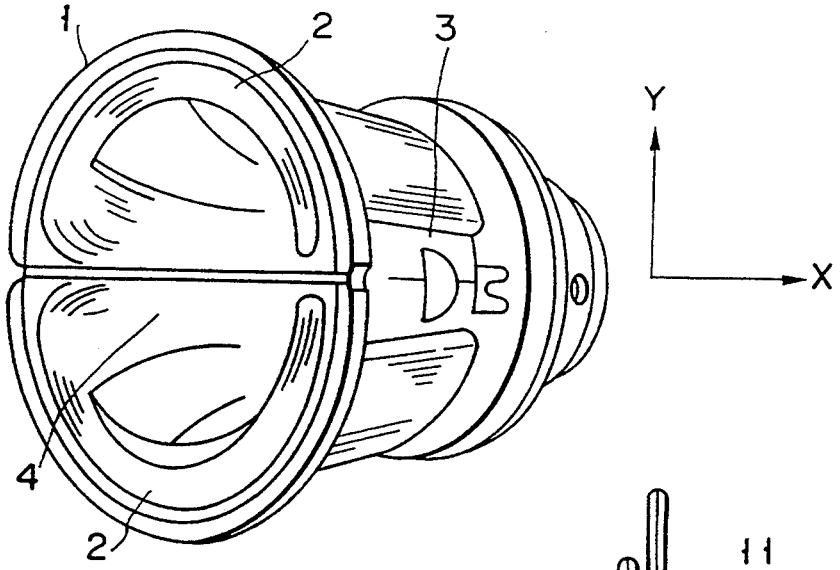
FIG. 1 (PRIOR ART)
FIG. 1 is a perspective view showing a deflection yoke of popular type for use in color cathode-ray tubes.
Figure 3:
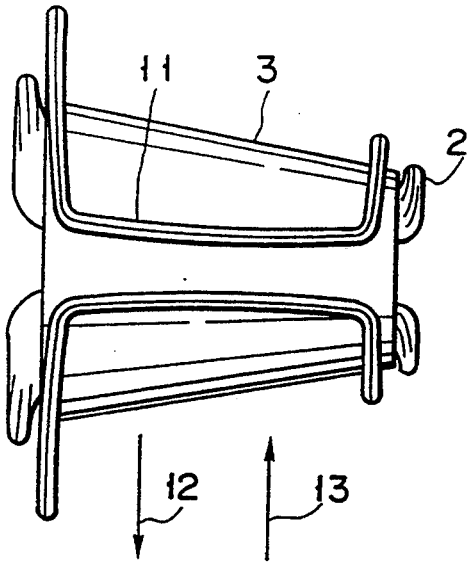
FIG. 3 (PRIOR ART)
FIG. 3 is a side view of a conventional deflection yoke having auxiliary coils for reducing leakage magnetic fluxes.
Figure 2:
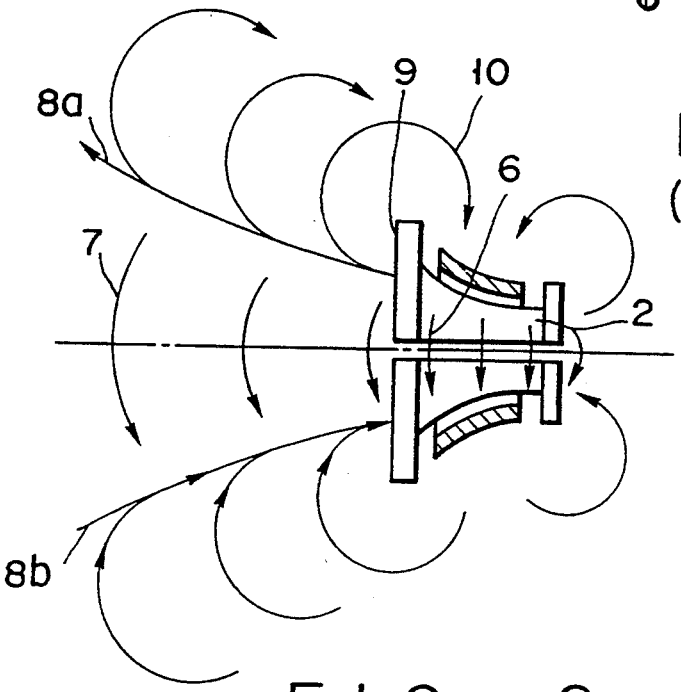
FIG. 2 (PRIOR ART)
FIG. 2 schematically represents the distribution of the magnetic fluxes generated by the horizontal deflection coils of the deflection yoke shown in FIG. 1.
Figure 4:
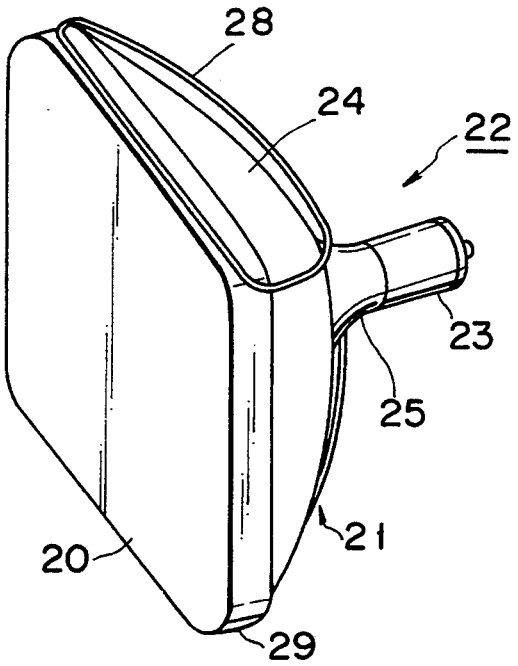
FIG. 4 is a schematic perspective view showing a color cathode-ray tube apparatus according to one embodiment of the present invention.
Figure 5:
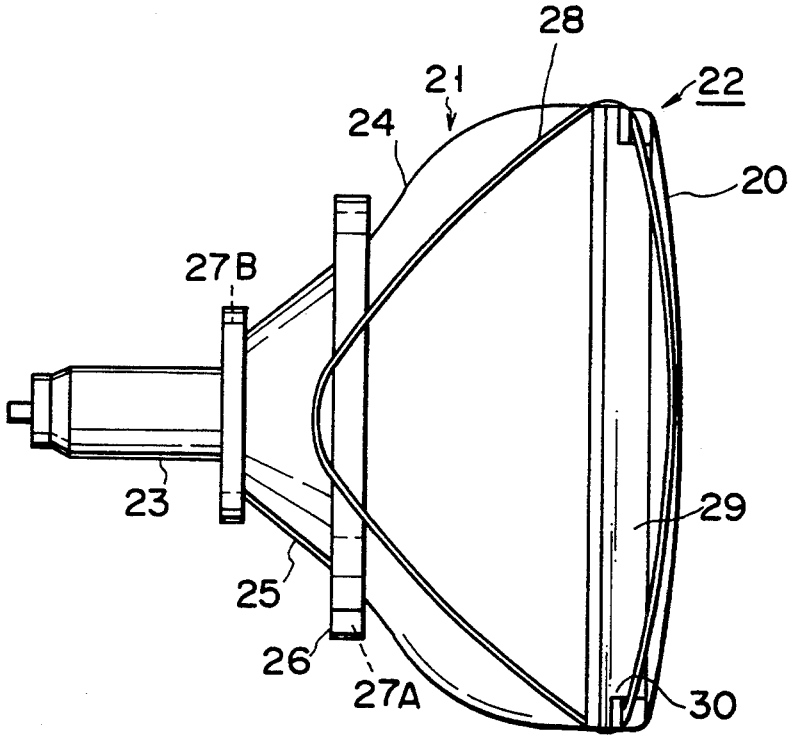
FIG. 5 is a schematic plan view illustrating the apparatus shown in FIG. 4.

FIGS. 4 and 5 schematically illustrate a color cathode-ray tube apparatus according to one embodiment of the present invention. The apparatus has an envelope 22 made of a substantially rectangular panel 20 and a funnel 21 formed integrally with the panel 20. The panel 20 has a face plate. A phosphor screen consisting of red, green, and blue phosphor layers is formed on the inner surface of the face plate. A shadow mask is provided within the funnel 21, opposing the phosphor screen. The funnel 21 comprises a neck portion 23 and a cone portion 24. In the neck portion 23, an electron gun assembly for emitting three electron beams is located. A deflection yoke 25 is wrapped around the Junction of the portions 23 and 24 in order to deflect the three electron beams emitted from the electron gun assembly.

The deflection yoke 25 comprises a molded hollow cylinder 26, a front flange 27A integrally formed with the cylinder 26, a rear flange 27B also integrally formed with the cylinder 26, a pair of curved saddle-type main horizontal deflection coils (not shown), and a pair of troidle-type vertical deflection coils (not shown, either). The main horizontal deflection coils are located within the hollow cylinder 26 and arranged symmetrically with respect to a horizontal plane including the axis of the cylinder 26. On the other hand, the vertical deflection coils are mounted on the cylinder 26 and arranged symmetrically with respect to said plane.

The color cathode-ray tube further comprises two loop-like closed compensating coils 28 mounted on the upper and lower sides of the cone portion 25 so as to maintain a curved form, respectively. Either coil 28 consists of at least one turn of wire, and is positioned such that its rear end rests on the front flange 27A, and its front end surrounds a pair of lugs 30 attached to the left and right ends of the upper or lower side, along with an explosion-proof band 29.

Figure 6:
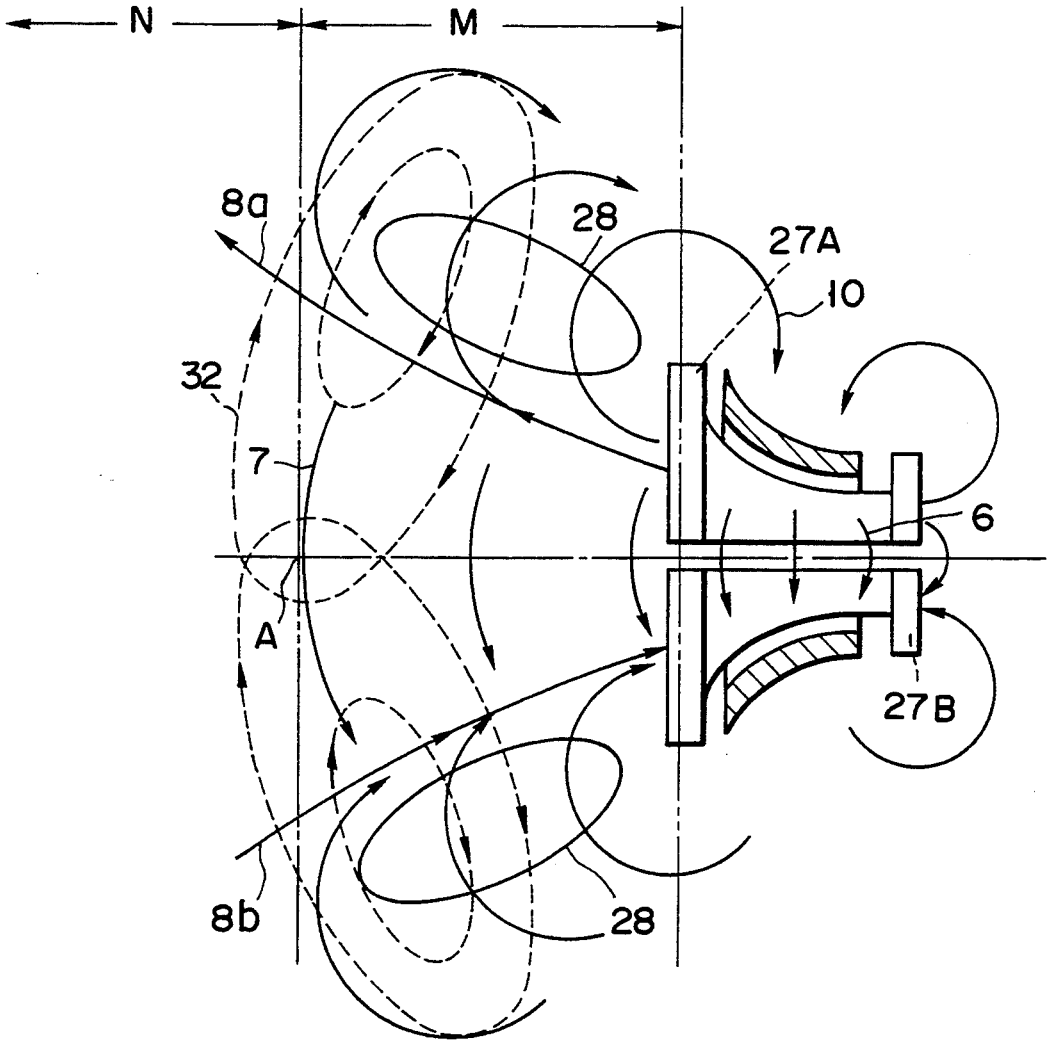
FIG. 6 is a diagram representing the distribution of magnetic fluxes, explaining the function of the closed compensating coils incorporated in the apparatus shown in FIGS. 4 and 5.

The closed compensating coils 28 are located in the field of leakage magnetic fluxes emanating from the main horizontal deflection coils. More specifically, as is shown in FIG. 6, both coils 28 are located outside the region which lies between curves 8*a* and 8*b*. In this region, leakage magnetic fluxes 7 extend substantially parallel to the effective magnetic fluxes 6 generated by the main horizontal deflection coils. Outside the region, other leakage magnetic fluxes 10 extend from the front flange 27A in the direction opposite to the direction of the effective magnetic fluxes 6. Hence, a current is induced in either closed compensating coil 28, whereby the coil 28 generates magnetic fluxes 32. The magnetic fluxes 32 are generated as the leakage magnetic fluxes 7 in the region M near the coil 28. In the region N extending from point A on the axis of the envelope 22, farther away from the yoke 25 than the region M, the magnetic fluxes 32 cancel out the leakage magnetic fluxes 7 emanating from the periphery of the color cathode-ray tube apparatus. The point A is 10 to 20 cm in front of the outer surface of the panel 20, depending on the size of the envelope 22, the configuration of the yoke 25, and the intensity of the magnetic fluxes 32.

Figure 7A:
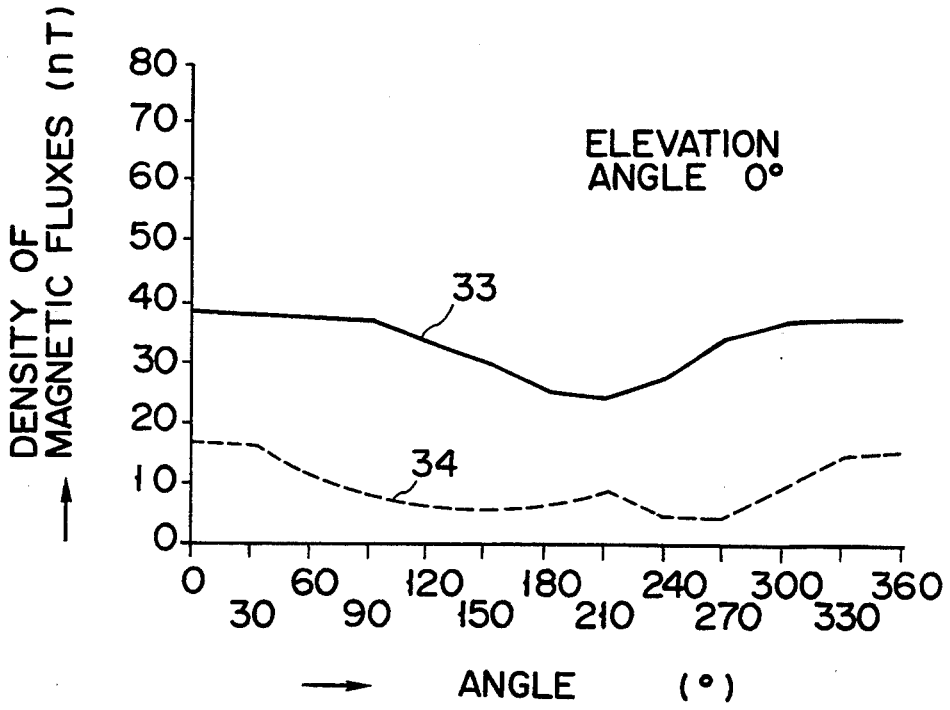
FIGS. 7A, 7B, and 7C are graphs demonstrating the the reduction of leakage magnetic fluxes achieved by the closed compensating coils.
Figure 7B:
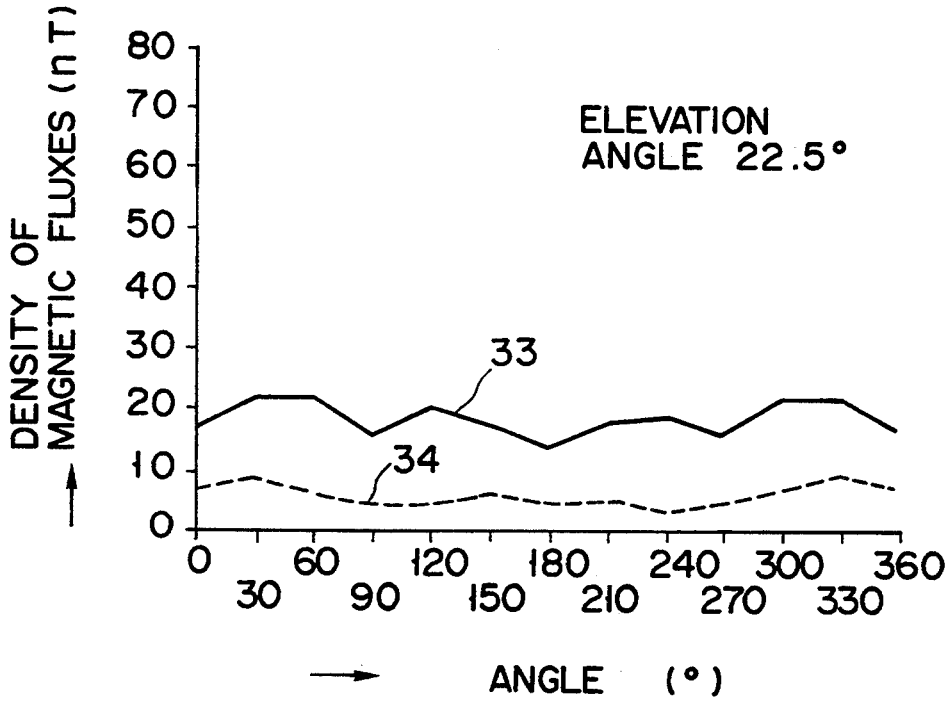
Figure 7C:
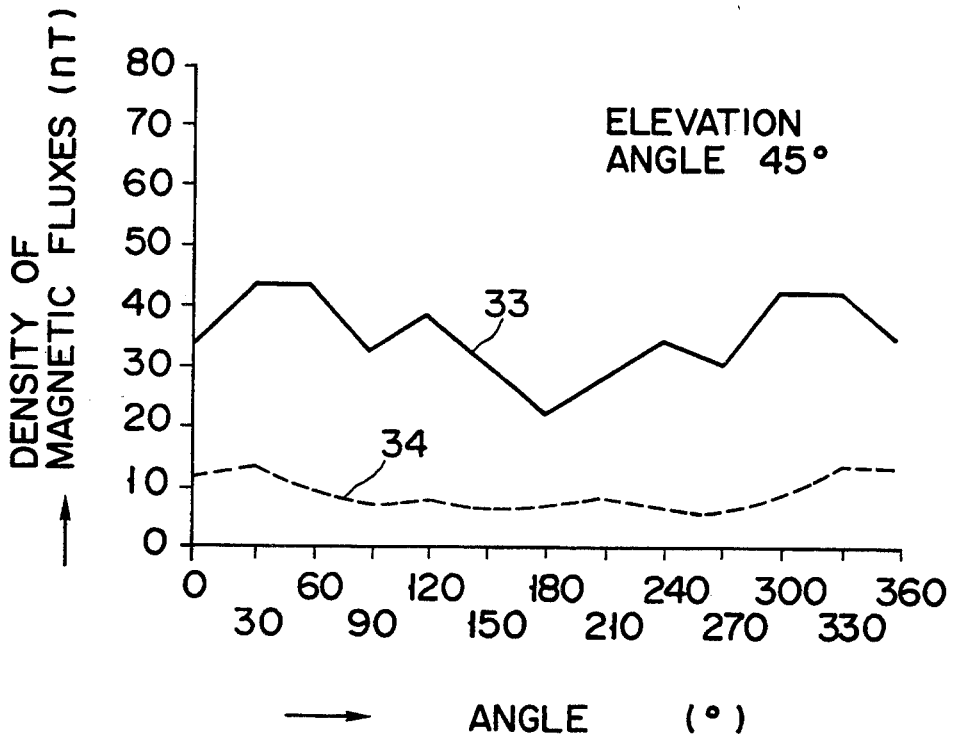

The magnetic fluxes 32 generated by the closed compensating coils 28 serve to reduce not only the leakage magnetic fluxes 7 extending in front of the color cathode-ray tube apparatus, but also the leakage magnetic fluxes 7 emanating from the periphery of the apparatus, as will be understood from FIGS. 7A, 7B, and 7C showing the results of the experiment conducted by the inventors hereof.

In the experiment, the inventors tested a color cathode-ray tube apparatus of the type shown in FIGS. 4 and 5 and also a color cathode-ray tube apparatus identical to the apparatus of FIGS. 4 and 5, but having no closed compensating coils, and measured the density nT of the leakage magnetic fluxes on the surface of a hollow sphere having a 65-cm radius and enclosing the apparatus, as is specified in the MRP Standards. FIG. 7A represents the relationship between the density nT and the position on the sphere surface (in degree), observed in either apparatus when the tangents to curves 8*a* and 8*b* are at an elevation angle of 0° to the axis of the color cathode-ray tube apparatus. FIG. 7B illustrates the density-position relationship observed in either apparatus when the tangents to curves 8*a* and 8*b* are inclined at an elevation angle of 22.5° to the axis of the cathode-ray tube apparatus. FIG. 7C shows the density-position relationship observed in either apparatus when the tangents to curves 8*a* and 8*b* are inclined at an elevation angle of 45.0°. In these figures, the solid-line curve indicates the density-position relationship observed in the conventional color cathode-ray tube apparatus, and the broken-line curve presents the the relationship observed in the color cathode-ray tube Of the present invention.

As is evident from the experimental results shown in FIGS. 7A, 7B, and 7C, the color cathode-ray tube apparatus of this invention, which has closed compensating coils, reduced leakage magnetic fluxes are reduced 50 to 60% more than the conventional color cathode-ray tube apparatus which has no closed compensating coils, and distributed leakage magnetic fluxes almost uniformly on the entire surface of the 65-cm radius sphere. In the apparatus of the invention, the leakage magnetic fluxes were reduced so much that the remaining leakage magnetic fluxes scarcely degraded the deflection characteristic such as beam convergence or the beam landing.

Another embodiment of the invention will now be described, with reference to FIGS. 8A and 8B and FIG. 9, in which the same numerals as those found in FIGS. 4, 5, and 6 are used, designating the same components and magnetic fluxes.

Figure 8A:
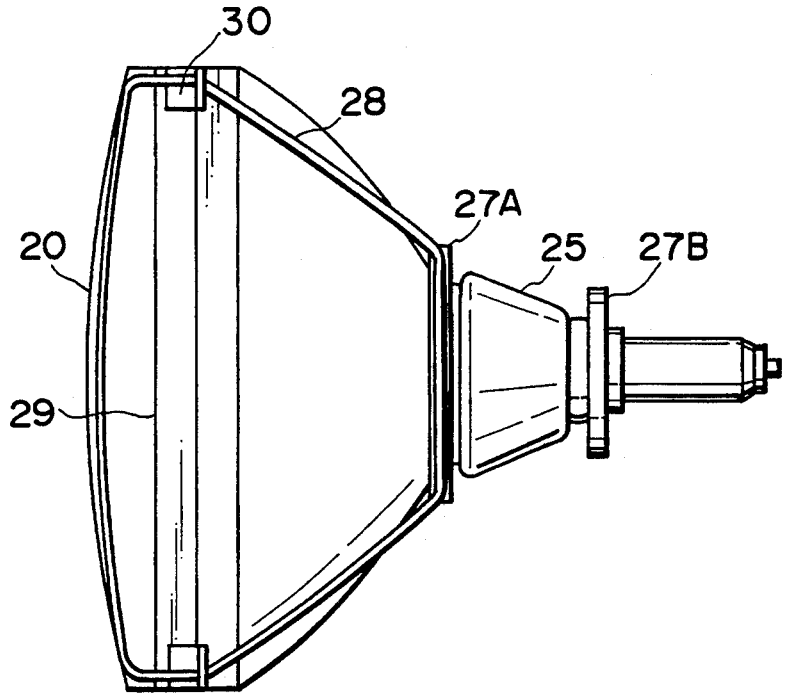
FIGS. 8A and 8B are a plan view and a side view, respectively, schematically illustrating a color cathode-ray tube according to another embodiment of the present application.
Figure 8B:
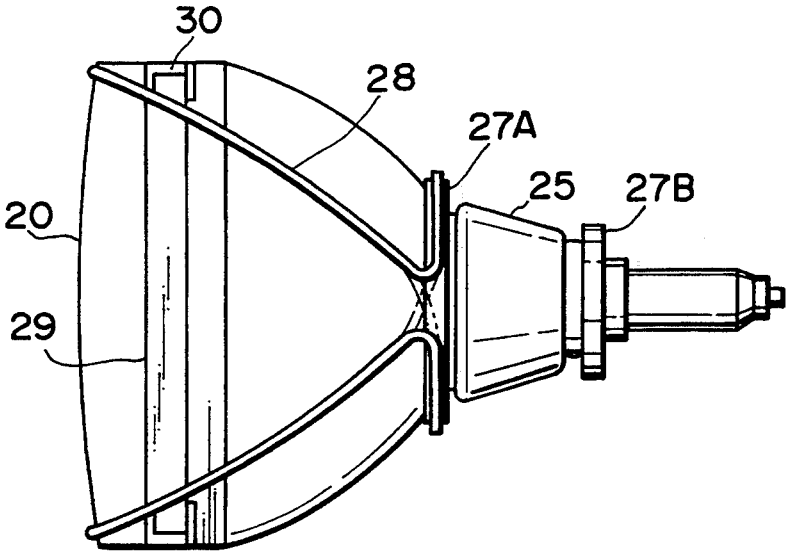
Figure 9:
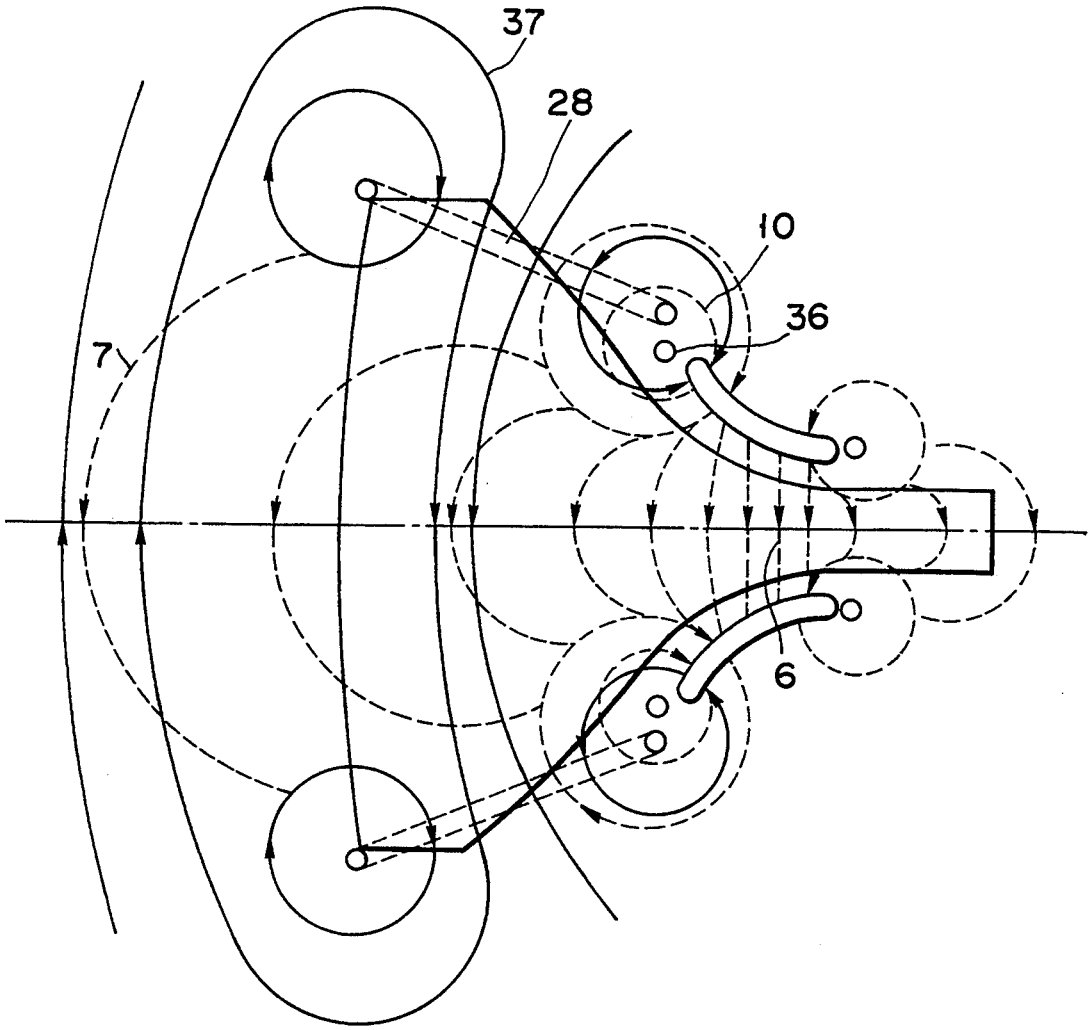
FIG. 9 is a diagram explaining the function of the closed compensating coils used in the apparatus shown in FIGS. 8A and 8B.

The color cathode-ray tube apparatus shown in FIGS. 8A and 8B is characterized by the use of two loop-shaped, closed compensating coils 28, either having a rear portion extending along the front flange 27A of the corresponding main horizontal deflection coil of a deflection yoke 25. Since the closed compensating coils 28 are so arranged, the intensity of the leakage magnetic fluxes 10 emanating from the front flange 27A is inversely proportional to the distance between them and the wires 36 located in the front flange 27, as can be understood from FIG. 9. Obviously, the leakage magnetic fluxes 10 crossing the closed compensating coils 28 gain a maximum intensity. Hence, a great current is induced in the coils 28, and the coils 28 generate compensating magnetic fluxes which are intense enough to reduce the leakage magnetic fluxes 10 sufficiently.

As is shown in FIGS. 8A and 8B, the front portion of either closed compensating coil 28 extends on both the left and right sides of the panel 20, optimally balancing the intensities of the two compensating magnetic fields existing in front of, and at the back of, the color cathode-ray tube apparatus, respectively. The intensity of either magnetic field is adjusted by the length of that portion of either coil 28 which extends along the front flange 27A and/or the area defined by the closed compensating coil 28. These compensating magnetic fields function, reliably reducing the changes dB/dt in leakage magnetic fluxes, to 15 mT/s or less.

Figure 10A:
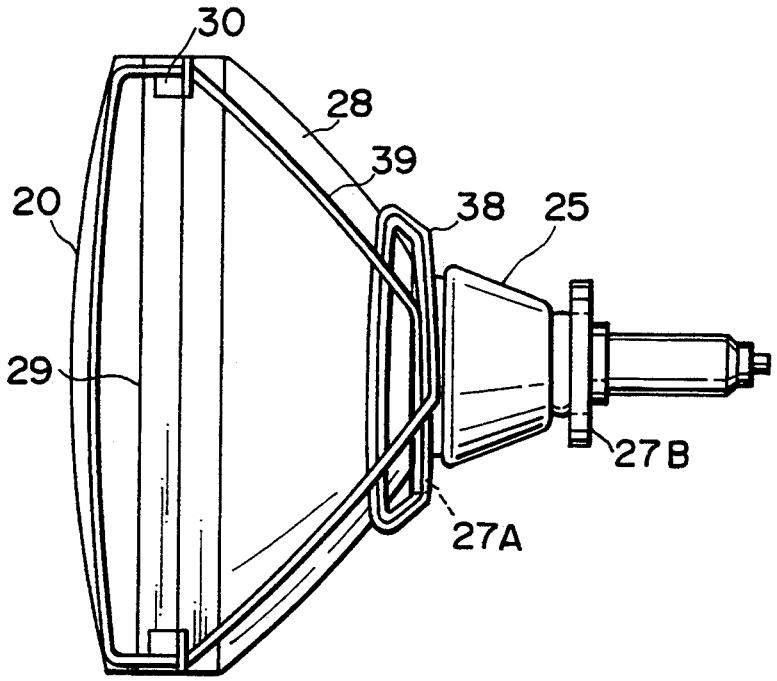
FIGS. 10A and 10B, FIGS. 11A and 11B, FIGS. 12A and 12B, FIGS. 13A and 13B, and FIGS. 14A and 14B are plan views and side views illustrating color cathode-ray tube apparatuses according to other five embodiments of the invention.
Figure 10B:
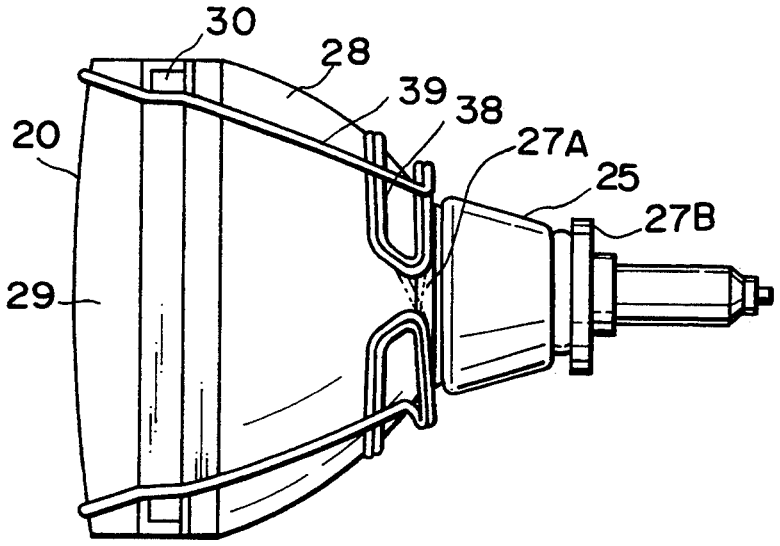

FIGS. 10A and 10B illustrate another color cathode-ray tube apparatus according to the invention. As comparison of FIGS. 8A and 8B, on the one hand, and FIGS. 10A and 10B, on the other, may reveal, this apparatus is identical to the color cathode-ray tube apparatus shown in FIGS. 8A and 8B, except that the rear portion of either closed compensating coil 28 is a double loop 38. According to the invention, the rear portion of the coil 28 can consist of more than two turns. Since the leakage magnetic fluxes emanating from the front flange 27A cross the double loop 38, a great current is induced in the large loop portion 39 of the coil 28. As a result of this, the coils 28 generate compensating magnetic fields which are more intense than those generated in the apparatus shown in FIGS. 8A and 8B.

Figure 11A:
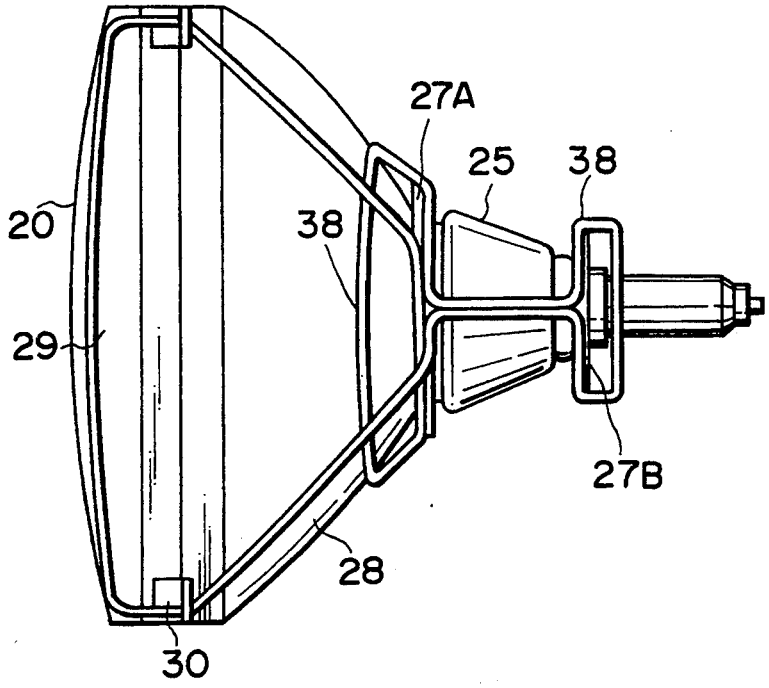
Figure 11B:
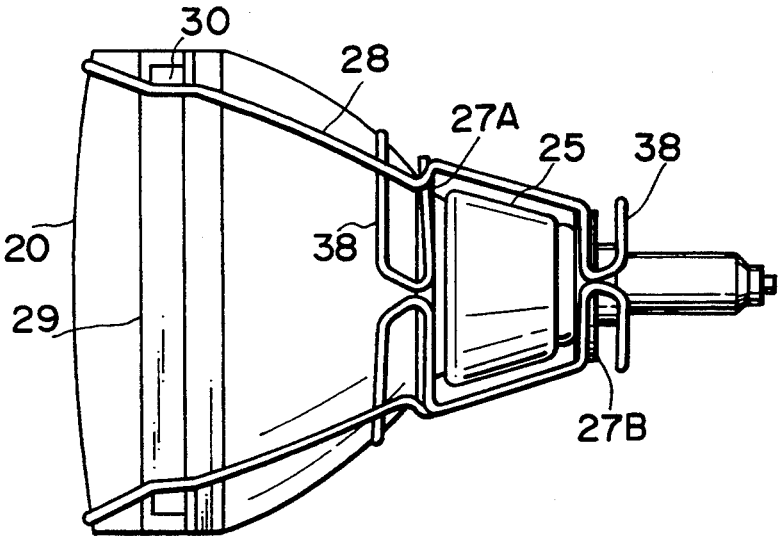

FIGS. 11A and 11B illustrate still another color cathode-ray tube apparatus according to the present invention. This apparatus is identical to that one shown in FIGS. 10A and 10B, except that either closed compensating coil 28 has two small loops 38 which are wound around the front flange 27A and the rear flange 27B, respectively. Since the leakage magnetic fluxes emanating from the front flange 27A cross the first small loop 30, and also those emanating from the rear flange 27B cross the second small loop 38, a greater current is induced in the large loop portion 39 of the coil 28 than in the apparatus illustrated in FIGS. 10A and 10B. Hence, the coils 28 generate compensating magnetic fields which are more intense than those generated in the apparatus shown in FIGS. 10A and 10B.

Figure 12A:
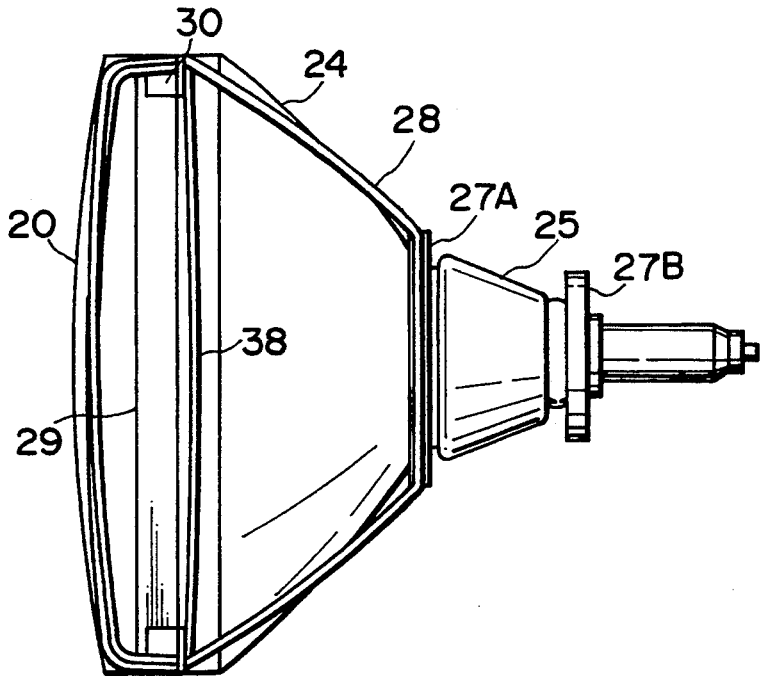
Figure 12B:
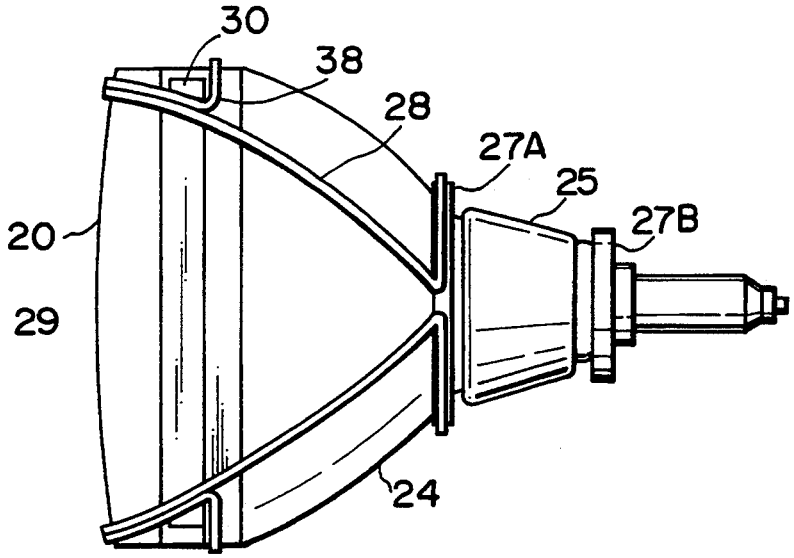

FIGS. 12A and 12B also show a color cathode-ray tube apparatus according to the present invention. This apparatus is designed based on the fact that in general, closed compensating coils, if mounted on the cone portion of the funnel of a color cathode-ray tube apparatus, are likely to generate a compensating magnetic field which is less intense in front of the apparatus than at the back of the apparatus. As comparison of FIGS. 8A and 8B, on the one hand, and FIGS. 12A and 12B, on the other, may reveal, this color cathode-ray tube apparatus is identical to the color cathode-ray tube apparatus shown in FIGS. 8A and 8B, except that either closed compensating coil 28 have a small loop 38 located on the top (bottom) of the panel 20. Since both small loops 38 are near the front of the apparatus, the compensating magnetic field the coils 28 is as intense in front of the apparatus as at the back of the apparatus.

Figure 13A:
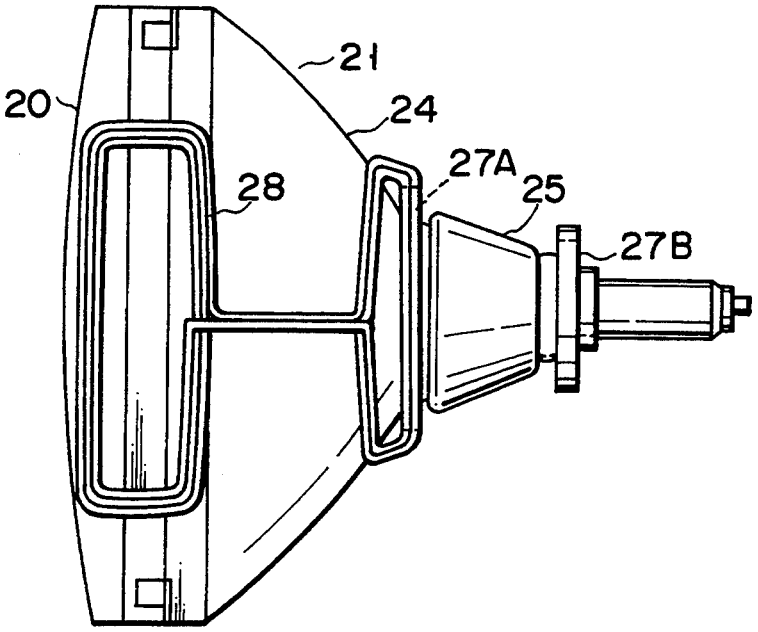
Figure 13B:
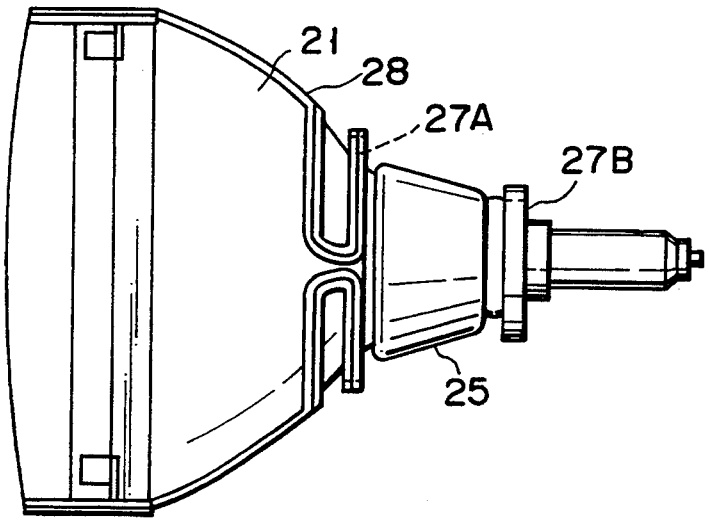

FIGS. 13A and 13B illustrates another color cathode-ray tube apparatus according to the invention which has a pair of closed compensating coils 28. Either closed compensating coil 28 comprises two loops, the first loop mounted on the top (bottom) of a panel 20, and the second loop located in front of the front flange 27A of a deflection yoke 25. The coil 28 generates a compensating magnetic field which is intense, particularly in front of the apparatus.

Figure 14A:
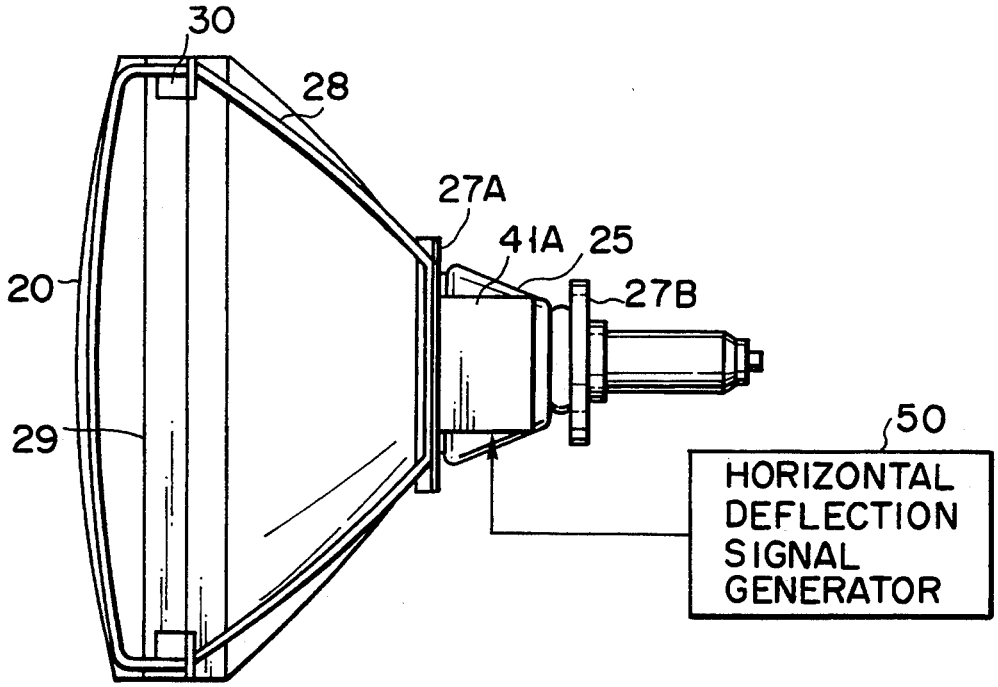
Figure 14B:
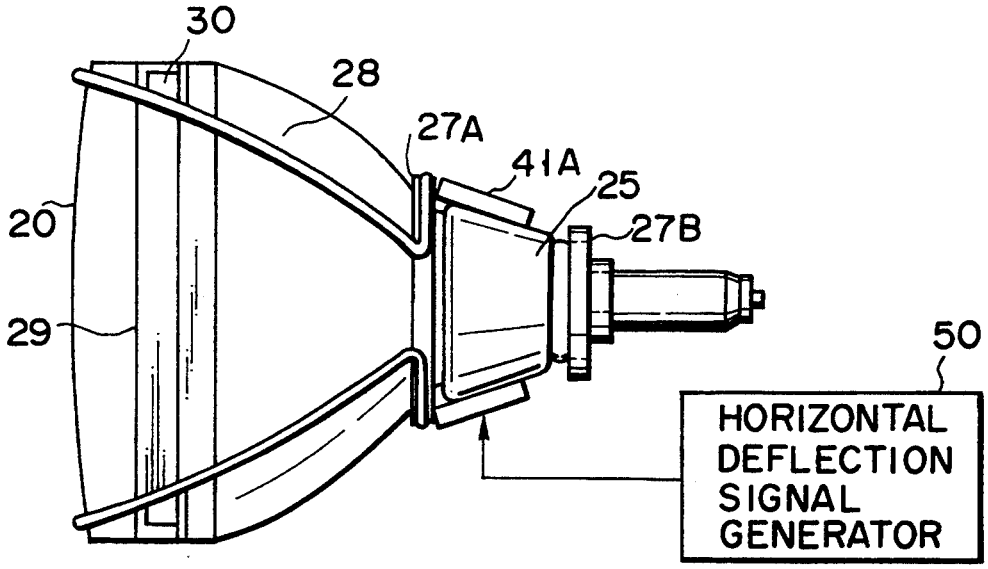

FIG. 14A and 14B show still another color cathode-ray tube apparatus according to the present invention. As comparison of FIGS. 8A and 8B, on the one hand, and FIGS. 14A and 14B, on the other, may reveal, this color cathode-ray tube apparatus is identical to the cathode-ray tube apparatus shown in FIGS. 8A and 8B, except that a pair or auxiliary coils 41A are mounted on the deflection yoke 25, and a horizontal-deflection signal is supplied to either auxiliary coil 41A from a horizontal deflection signal generator 50. This color cathode-ray tube apparatus is designed based on the two facts. First, the compensating magnetic field, which a closed compensating coil generates from the current induced in the coil from the leakage magnetic fluxes crossing the coil, has but a limited intensity even if the coil has a complex shape to extend across more leakage magnetic fluxes, just because the more complex the coil, the higher its resistance or inductance. Secondly, the more simple the coil, the better, in view of the manufacturing cost of the color cathode-ray tube apparatus.

Figure 15:
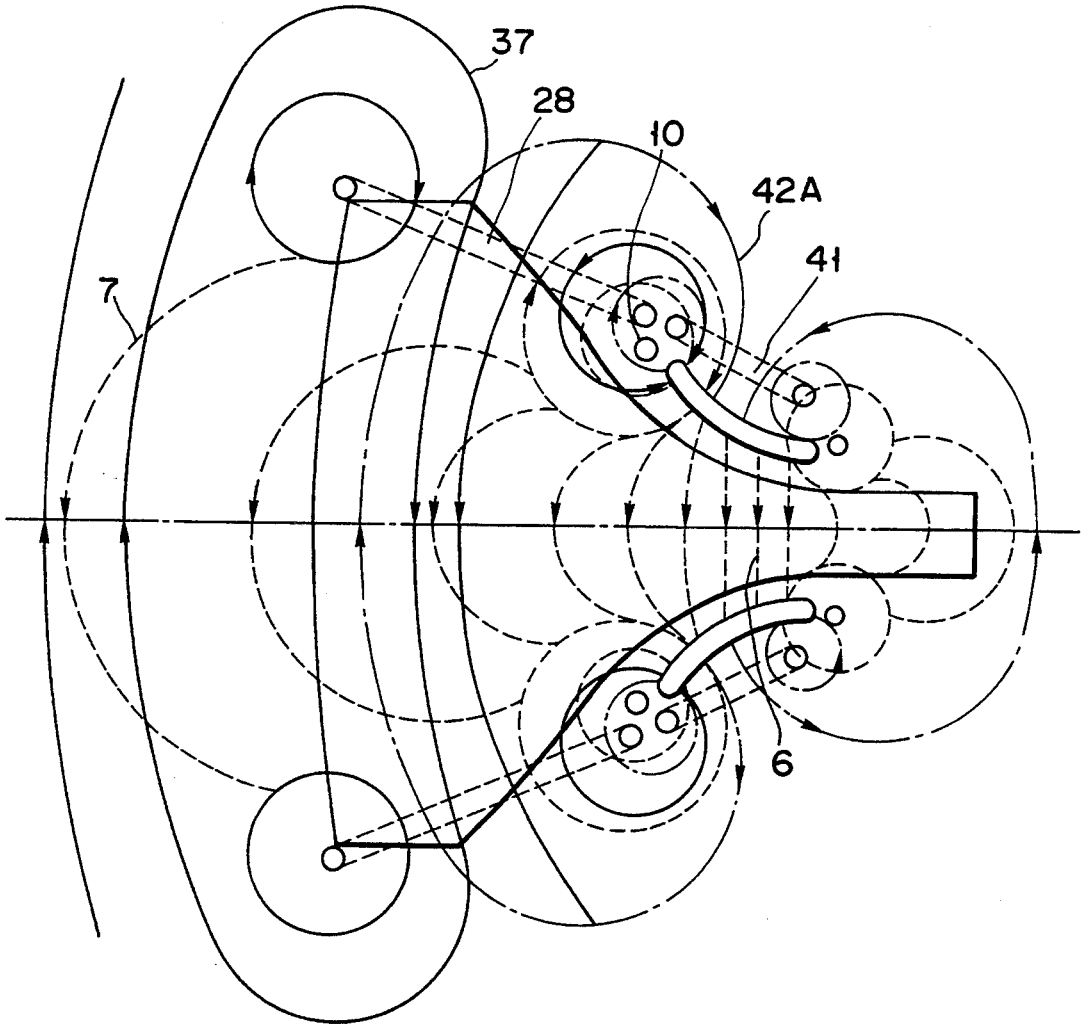
FIG. 15 is a diagram representing the distribution of magnetic fluxes, explaining the function of the closed compensating coils incorporated in the embodiment shown in FIGS. 13A and 13B.

Since the auxiliary coils 41A are located at the rear of the closed compensating coils 28 as is shown in FIGS. 14A and 14B, they generate magnetic fluxes 42 which extend in the same direction as the main magnetic fluxes generated by the main horizontal deflection coils as is illustrated in FIG. 15. These magnetic fluxes 42 also extend in the same direction as the compensating magnetic fluxes 37 emanating from the coils 28 in front of, and at the back of, the apparatus, thus cooperating with the magnetic fluxes 37 to cancel out the leakage magnetic fluxes 7. Further, the magnetic fluxes 41 intensify the compensating magnetic fields generated by the coils 28 since they extend in the same direction as the leakage magnetic fluxes 7 and cross the closed compensating coils 28.

Figure 16A:
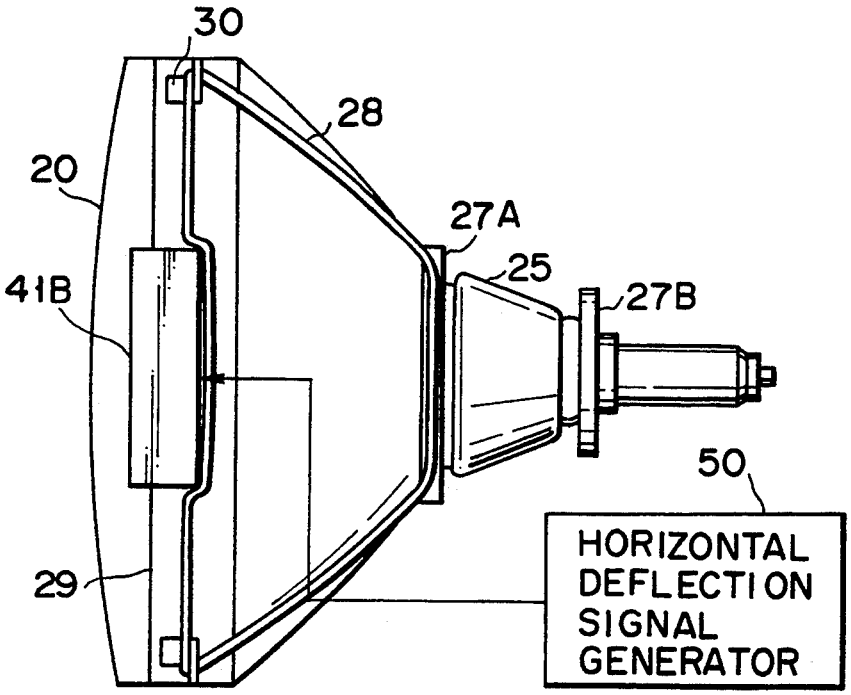
FIGS. 16A and 16B, FIGS. 17A and 17B, and FIGS. 18A and 18B are plan views and side views showing color cathode-ray tube apparatuses according to still three other embodiments of the invention.
Figure 16B:
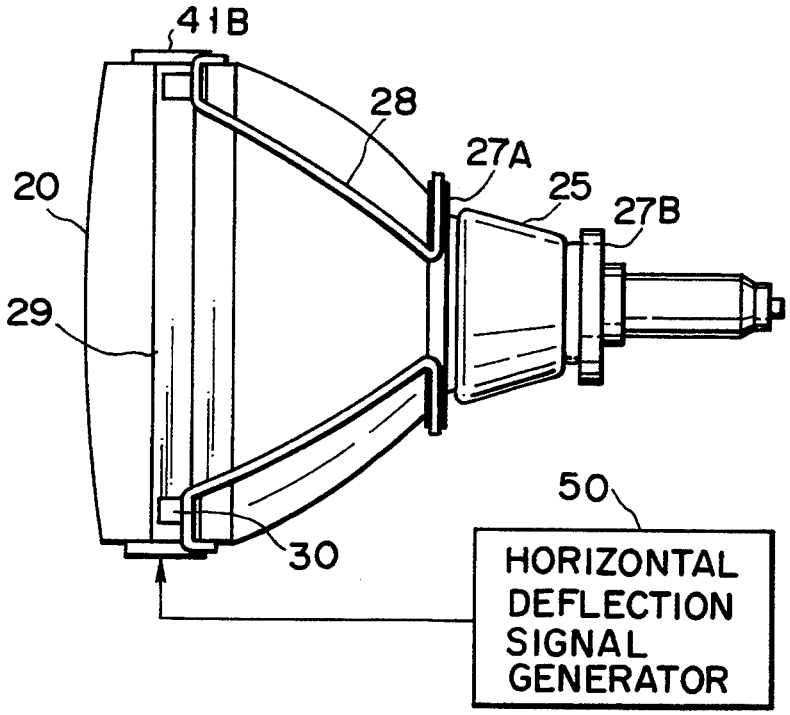

FIG. 16A and 16B show still another color cathode-ray tube apparatus according to the present invention. As comparison of FIGS. 8A and 8B, on the one hand, and FIGS. 14A and 14B, on the other, may reveal, this cathode-ray tube apparatus is identical to the apparatus shown in FIGS. 8A and 8B, except that a pair of auxiliary coils 41B are mounted on the top and bottom of the panel 20, respectively. This apparatus attains advantages similar to those of the apparatus shown in FIGS. 14A and 14B.

Figure 17A:
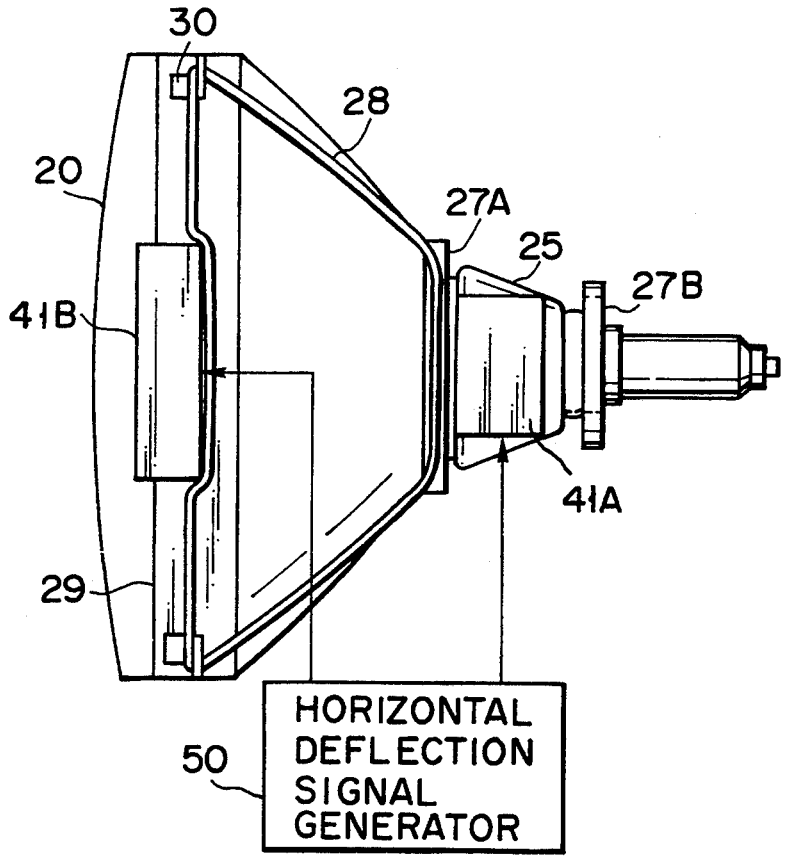
Figure 17B:
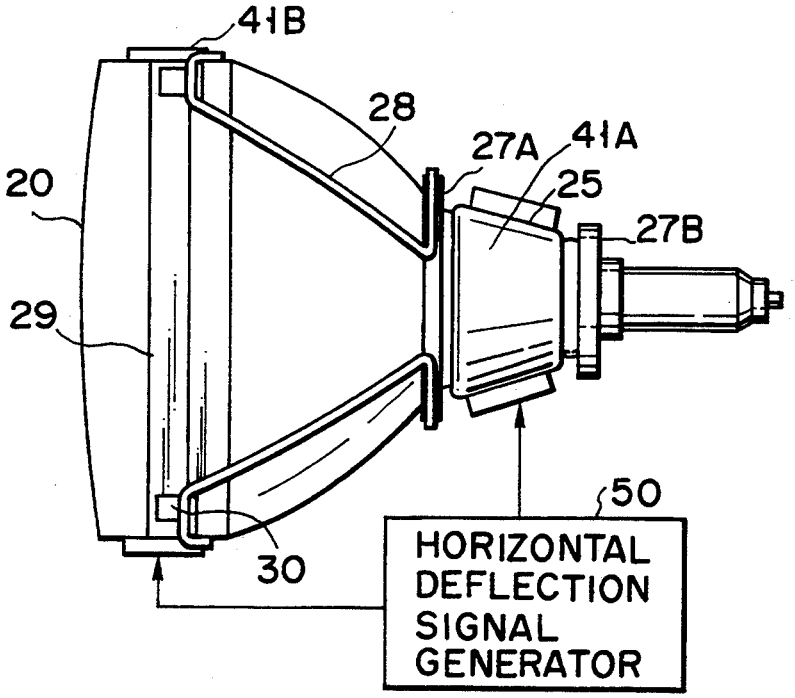

FIGS. 17A and 17B illustrates another color cathode-ray tube apparatus, which is a combination of the apparatus shown in FIGS. 14A and 14B and the apparatus shown in FIGS. 16A and 16B. In other words, a pair of rear auxiliary coils 41A are mounted on the deflection yoke 25, and a pair of front auxiliary coils 41B are mounted on the top and bottom of the panel 20. A horizontal deflection signal may be supplied from the signal generator 50 to the from auxiliary coils 41B, causing the coils 41B to generate compensating magnetic field for canceling the leakage magnetic fluxes. The inductive magnetic fluxes which the coils 28 generate, and the compensating magnetic fluxes which the coils 41A and 41B generate, work together, reliably reducing the the leakage magnetic fluxes. For the functional details of the two pairs of auxiliary coils 41A and 41B, refer to U.S. patent application Ser. No. 07/535,197 filed Jun. 8, 1990, for the invention entitled "Cathode Ray Tube Apparatus Intended to Reduce Magnetic Fluxes Leaked Outside the Apparatus"; inventors: Masahiro Yokota, Hideo Mori, and Kiyoshi Oyama [European Patent Application No. 90110822.5 filed Jun. 7, 1990 for the invention entitled "Cathode Ray Tube Apparatus Intended to Reduce Magnetic Fluxes Leaked Outside the Apparatus"; inventors: Masahiro Yokota, Hideo Mori, and Kiyoshi Oyama].

Figure 18A:
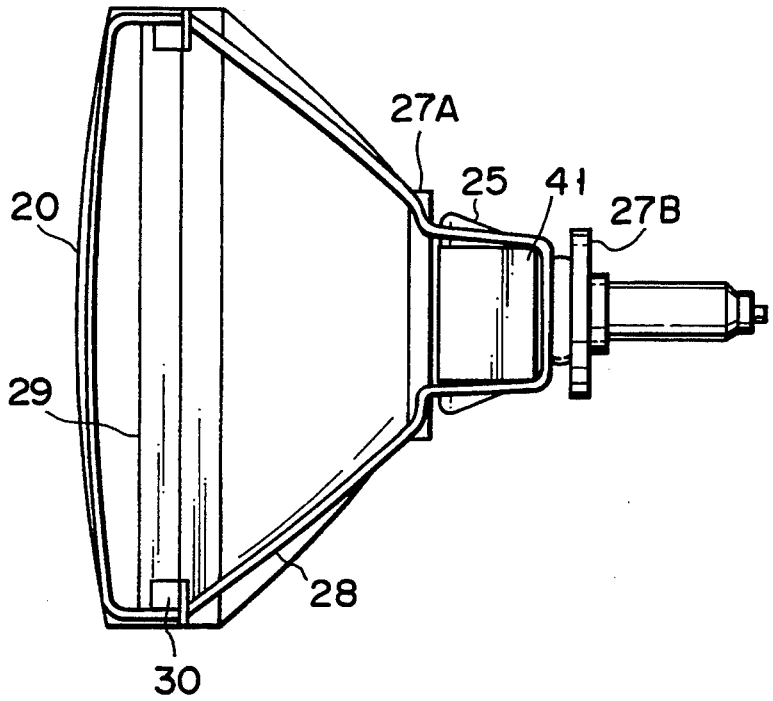
Figure 18B:
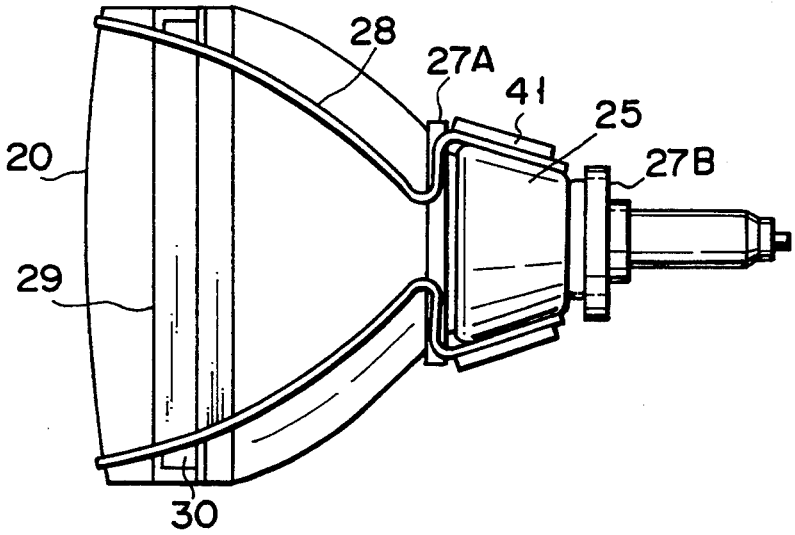

FIGS. 18A and 18B illustrates another color cathode-ray tube apparatus according to the present invention. As comparison of FIGS. 14A and 14B, on the one hand, and FIGS. 18A and 18B, on the other, may reveal, this color cathode-ray tube apparatus is identical to the apparatus shown in FIGS. 14A and 14B, except that either closed compensating coil 28 extends rearward beyond the front flange 27A, and is wrapped around the corresponding auxiliary coil 41. The magnetic fluxes emanating from both auxiliary coils 41 extend in the direction opposite to that shown in FIG. 15, but intensify the the compensating magnetic fields generated by the closed compensating coils 28. Hence, the auxiliary coils 41 not only intensify the compensating magnetic fluxes existing in front of the apparatus, but also diminish the over intensification of the compensating magnetic fluxes existing at the back of the apparatus.

The present is not limited to the embodiments described above, wherein the closed compensating coils are not electrically connected to each other, and spaced apart one above the other. Rather, the invention can be applied to, for example, a color cathode-ray tube apparatus in which a pair of closed compensating coils are electrically connected as is indicated by the broken lines in FIGS. 8A and 8B, thus forming a single closed loop.

All embodiments described above are color cathode-ray tube apparatuses. Needless to say, the present invention can be applied to cathode-ray tubes of any other types.

As has been described, a cathode-ray tube apparatus according to the present invention has a pair of closed compensating coils located, such that either has its part located near the front of the corresponding main horizontal deflection coil of a saddle-type deflection yoke and in the region in which leakage magnetic fluxes emanating from the front flange of the main horizontal deflection coil in the direction opposite to that of the main magnetic fluxes emanating from the main horizontal deflection coil. Hence, a current is induced in either closed compensating coil, from the leakage magnetic fluxes, and the closed compensating coil generates compensating magnetic fluxes. The compensating magnetic fluxes reduces the leakage magnetic fluxes emanating from the periphery of the apparatus, uniformly in a space around the apparatus, without degrading the beam-deflecting characteristics of the cathode-ray tube apparatus.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A cathode-ray tube apparatus wherein unwanted leakage magnetic fluxes are controlled, comprising:

electron beam emitting means for emitting electron beams;

light ray producing means for producing light rays when irradiated with the electron beams;

an envelope having an axis and enclosing said electron beam emitting means and said light ray producing means;

deflection magnetic field generating means located outside said envelope and having a curved front section and a rear section, the front section located at a light ray producing means side of said deflection magnetic field generating means and said rear section located at an electron beam emitting side of said deflection magnetic field generating means, said deflection field generating means for generating and applying effective magnetic fluxes into said envelope to deflect the electron beam in a horizontal direction, said deflection magnetic field generating means also generating leakage magnetic fluxes extending in a direction different from that of the effective magnetic fluxes; and passive control means for controlling said leakage magnetic fluxes, said passive control means having a section curved along the curved front section of said deflection magnetic field generating means and directly mounted on the curved front section so that said passive control means is located across the leakage magnetic fluxes, said leak magnetic fluxes generated from the curved front section, inducing a current in said passive control means resulting in compensating magnetic fluxes being produced, said compensating magnetic fluxes controlling said leakage magnetic fluxes, said passive control means being located such that said compensating magnetic fluxes do not adversely affect said effective magnetic fluxes.

2. The apparatus according to claim 1, wherein said passive control means includes a first closed current path and a second current path which are symmetrical with respect to the axis of said envelope.

3. The apparatus according to claim 2, wherein said first and second closed current paths are electrically isolated.

4. The apparatus according to claim 2, wherein said first and second closed current paths are electrically connected.

5. The apparatus according to claim 1, wherein said leakage magnetic fluxes include magnetic fluxes which extend in an opposite direction to said effective magnetic fluxes.

6. The apparatus according to claim 1, further comprising auxiliary active control means, outside said envelope; and flux generating/applying means for generating magnetic fluxes and applying these magnetic fluxes to said auxiliary active control means.

7. The apparatus according to claim 6, wherein said flux generating/applying means generates magnetic fluxes in said auxiliary active control means which extend in a direction substantially identical to that of the leakage magnetic fluxes.

8. The apparatus according to claim 6, wherein said flux generating/applying means generates magnetic fluxes in said auxiliary active control means which extend in a direction substantially identical to the direction of the compensating magnetic fluxes generated by said passive control means.

9. A cathode-ray tube apparatus wherein unwanted leakage magnetic fluxes are controlled, comprising;

an envelope having an axis and comprising a panel having a face plate and a skirt attached to the face plate, a funnel connected to the skirt of the panel, and a neck extending from the funnel;

an electron gun assembly located within said neck, for emitting electron beams;

a screen formed on said face plate, for producing light rays when irradiated with the electron beams;

horizontal deflection means mounted on said funnel and having a curved front section and a rear section, the front section located at a screen side of said horizontal deflection means and said rear section located at an electron gun assembly side of said horizontal deflection means, said horizontal deflection means for generating deflection magnetic fields which deflect the electron beams in a horizontal direction, and horizontal deflection means also generating leakage magnetic fluxes outside said envelope; and closed loop conductor means extending along the skirt of said panel, along said funnel toward said horizontal deflection means, including a section curved along the curved front section of the horizontal deflection means and directly mounted on the curved front section, and crossing the leakage magnetic fluxes generated by the curved front section, said leakage magnetic fluxes inducing a current in said closed loop conductor resulting in compensating magnetic fluxes, said compensating magnetic fluxes controlling said leakage magnetic fluxes, said closed loop conductor located such that said compensating magnetic fluxes do not adversely affect said deflection magnetic fields.

10. The apparatus according to claim 9, wherein said closed loop conductor means includes two conductive wire members which form a first loop and a second loop, which are symmetrical with respect to the axis of said envelope.

11. The apparatus according to claim 10, wherein said first and second conductive wire members are electrically isolated.

12. The apparatus according to claim 10, wherein said first and second conductive wire members are electrically connected.

13. The apparatus according to claim 10, wherein said horizontal deflection means includes a flange section allowing passage of the leakage magnetic fluxes.

14. The apparatus according to claim 13, wherein said first and second conductive wire members each has a section extending over said flange section.

15. The apparatus according to claim 10, wherein said first and second conductive wire members include a third loop and a fourth loop, respectively.

16. The apparatus according to claim 15, wherein said third and fourth loops are mounted on said funnel.

17. The apparatus according to claim 15, wherein said third and fourth loops are mounted on said skirt.

18. The apparatus according to claim 15, wherein said third and fourth loops are located close to said neck.

19. The apparatus according to claim 9, further comprising auxiliary active control means outside said envelope; and flux generating/applying means for generating and applying magnetic fluxes to said auxiliary active control means.

20. The apparatus according to claim 19, wherein said flux generating/applying means generates magnetic fluxes in said auxiliary active control means which extend in a direction substantially identical to that of the leakage magnetic fluxes.

21. The apparatus according to claim 19, wherein said flux generating/applying means generates magnetic fluxes in said auxiliary active control means which extend in a direction substantially identical to the direction of the compensating magnetic fluxes generated by said closed loop conductor means.

22. A cathode-ray tube apparatus according to claim 9, wherein said curved section of said closed loop conductor means forms two or more loops around said horizontal deflection means.

23. A cathode-ray tube apparatus according to claim 9, further comprising a deflection yoke, disposed between said funnel and said neck of said envelope, including a hollow cylinder, a front flange located at a first end of said hollow cylinder, and a rear flange located at a second end of said hollow cylinder; and wherein said curved section of said closed loop conductor means includes first and second small loops wound around said front and rear flange, respectively.

24. A cathode-ray tube apparatus according to claim 9, further comprising a deflection yoke, disposed between said funnel and said neck of said envelope, including a hollow cylinder, a front flange located at a first end of said hollow cylinder, and a rear flange located at a second end of said hollow cylinder; and wherein said closed loop conductor means includes said curved section forming a first loop wrapped around in front of said front flange and a second section forming a second loop mounted on top of said panel of said envelope.

25. A cathode-ray tube apparatus for suppressing leakage magnetic flexes, comprising:

electron beam emitting means for emitting at electron beam;

light ray producing means for producing light rays when irradiated with said electron beam;

an envelope having an axis and enclosing said electron beam emitting means and said light ray producing means;

deflecting magnetic field generating means, located on said envelope and having a front and rear edge section, for generating and applying effective magnetic fluxes in said envelope to deflect the electron beam in a horizontal direction, and also generating first and second leakage magnetic fluxes extending in a direction different from that of said effective magnetic fluxes, the first leakage magnetic fluxes being greater in magnitude than said second leakage magnetic fluxes and being substantially distributed between said front edge section and said light ray producing means, and said second leakage magnetic fluxes being substantially distributed between said rear edge section and said electron beam emitting means; and passive control means, including a pair of closed loops each of which having a portion mounted on said front edge section, for controlling said first and second leakage magnetic fluxes, said pair of closed loops being arranged on said envelope so as to be substantially symmetrical to said axis in order to receive said first leakage magnetic fluxes, whereby a current is electromagnetically induced in each of said closed loops when said first leakage magnetic fluxes are applied to said closed loops, thereby generating compensating magnetic fields from the closed loops.

26. A cathode-ray tube apparatus for suppressing leakage magnetic fluxes, comprising:

an envelope having an axis and comprising a panel having a face plate and a skirt attached to said face plate, a funnel connected to said skirt of said panel, and a neck extending from said funnel;

an electron gun assembly located within said neck, for emitting electron beams;

a screen formed on said face plate, for producing light rays when irradiated with said electron beams;

horizontal deflection means mounted on said funnel and having a front and rear edge section, for generating deflection magnetic fluxes to deflect said electron beams in said envelope in a horizontal direction, and also for generating first and second leakage magnetic fluxes in a direction different from that of said deflection magnetic fluxes, said first leakage magnetic fluxes being greater in magnitude than said second leakage magnetic fluxes and being substantially distributed between said front edge section and said screen, and said second leakage magnetic fluxes being substantially distributed between said rear edge section and said electron gun assembly; and a pair of closed loop conductors arranged so as to be substantially symmetric with respect to said axis; each of said conductors extending along said skirt of said panel and also along said funnel toward said horizontal deflection means and having a part located on said front edge section, wherein said conductors cross said first leakage magnetic fluxes, thereby inducing a current to be generated in said conductors and causing compensating magnetic fluxes to be generated.

* * * * *